US008247723B2

(12) United States Patent
Tang et al.

(10) Patent No.: US 8,247,723 B2
(45) Date of Patent: Aug. 21, 2012

(54) ELECTRONIC DEVICE

(75) Inventors: Zi-Ming Tang, Shenzhen (CN); Wei-Jun Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 416 days.

(21) Appl. No.: 12/650,847

(22) Filed: Dec. 31, 2009

(65) Prior Publication Data

US 2011/0089012 A1 Apr. 21, 2011

(30) Foreign Application Priority Data

Oct. 15, 2009 (CN) ..... 2009 1 0308312

(51) Int. Cl.
*H01H 13/02* (2006.01)

(52) U.S. Cl. ..... 200/522; 200/329

(58) Field of Classification Search ..... 200/522, 200/296, 329, 547, 536, 252, 531
See application file for complete search history.

(56) References Cited

U.S. PATENT DOCUMENTS

2008/0029374 A1* 2/2008 Christopher et al. ..... 200/329
* cited by examiner

*Primary Examiner* — Renee S Luebke
*Assistant Examiner* — Lheiren Mae Caroc
(74) *Attorney, Agent, or Firm* — Altis Law Group, Inc.

(57) ABSTRACT

An electronic device includes a power switch, an elastic force member adjacent to the power switch, a triggering member fixed on the elastic force member to trigger the power switch, and an elastic reposition member. The triggering member is capable of sliding between a first position and a second position relative to the power switch. The elastic reposition member provides elastic force to move the triggering member from the first position to the second position. In the first position, the triggering member faces the power switch and can be pressed to trigger the power switch. In the second position, the triggering member is away from the power switch.

15 Claims, 5 Drawing Sheets

ELECTRONIC DEVICE

BACKGROUND

1. Technical Field

The present disclosure relates to an electronic device having a power switch.

2. Description of Related Art

Electronic devices, such as desktop computers, notebook computers, and digital video disc players, are very popular and widely used. An electronic device generally includes a power switch and a contact assembly. The contact assembly includes an elastic reposition member and a triggering member used to trigger the power switch. During operation, external force applied on the elastic reposition member impels the triggering member to trigger the power switch. When the external force is released, the triggering member withdraws by elastic force generated by the elastic reposition member.

However, the power switch is easily triggered, thus causing unwanted interruption of power that can, for example, result in lost work, or even severe hardware damage.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Figure 1:
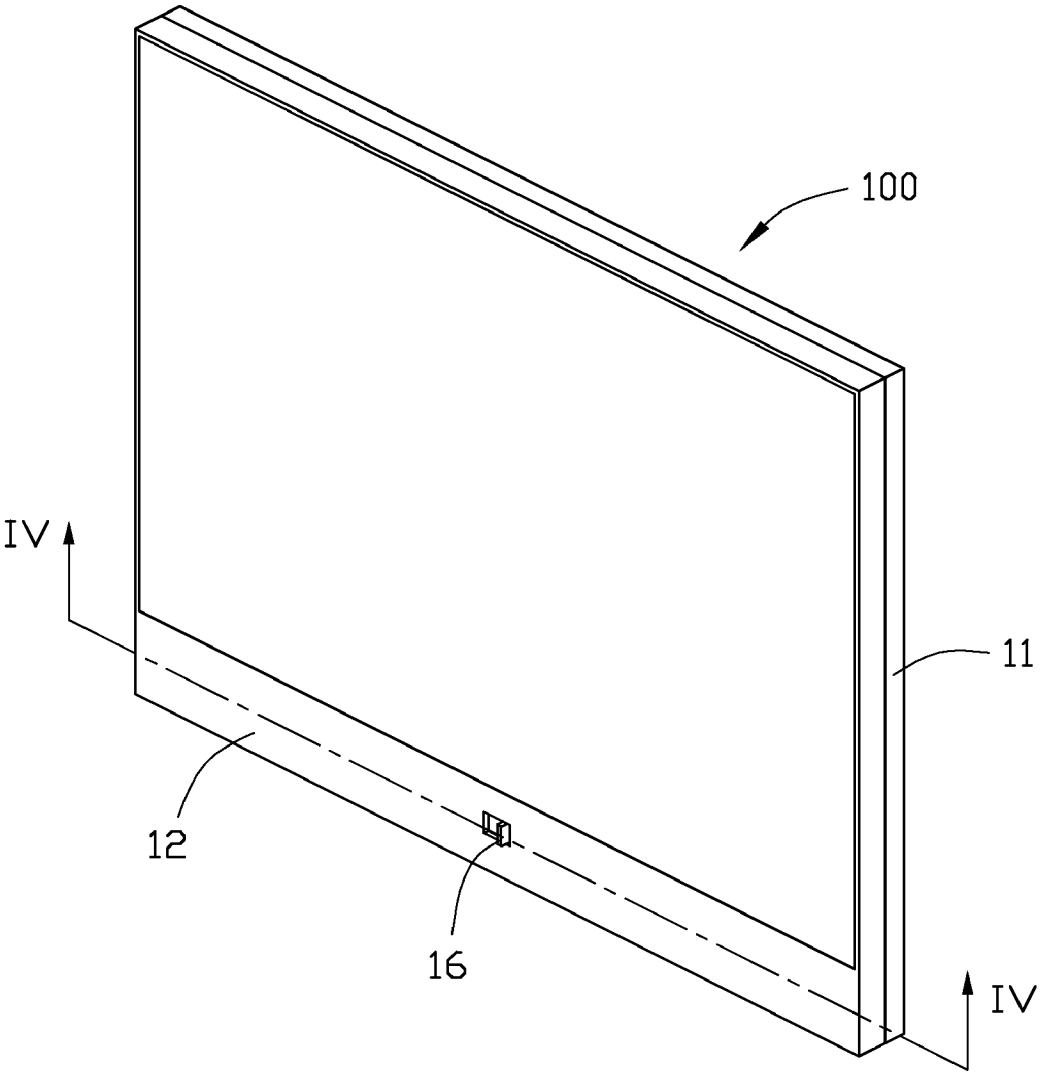
FIG. 1 is an assembled, isometric view of an embodiment of an electronic device, the electronic device including a triggering member.
Figure 2:
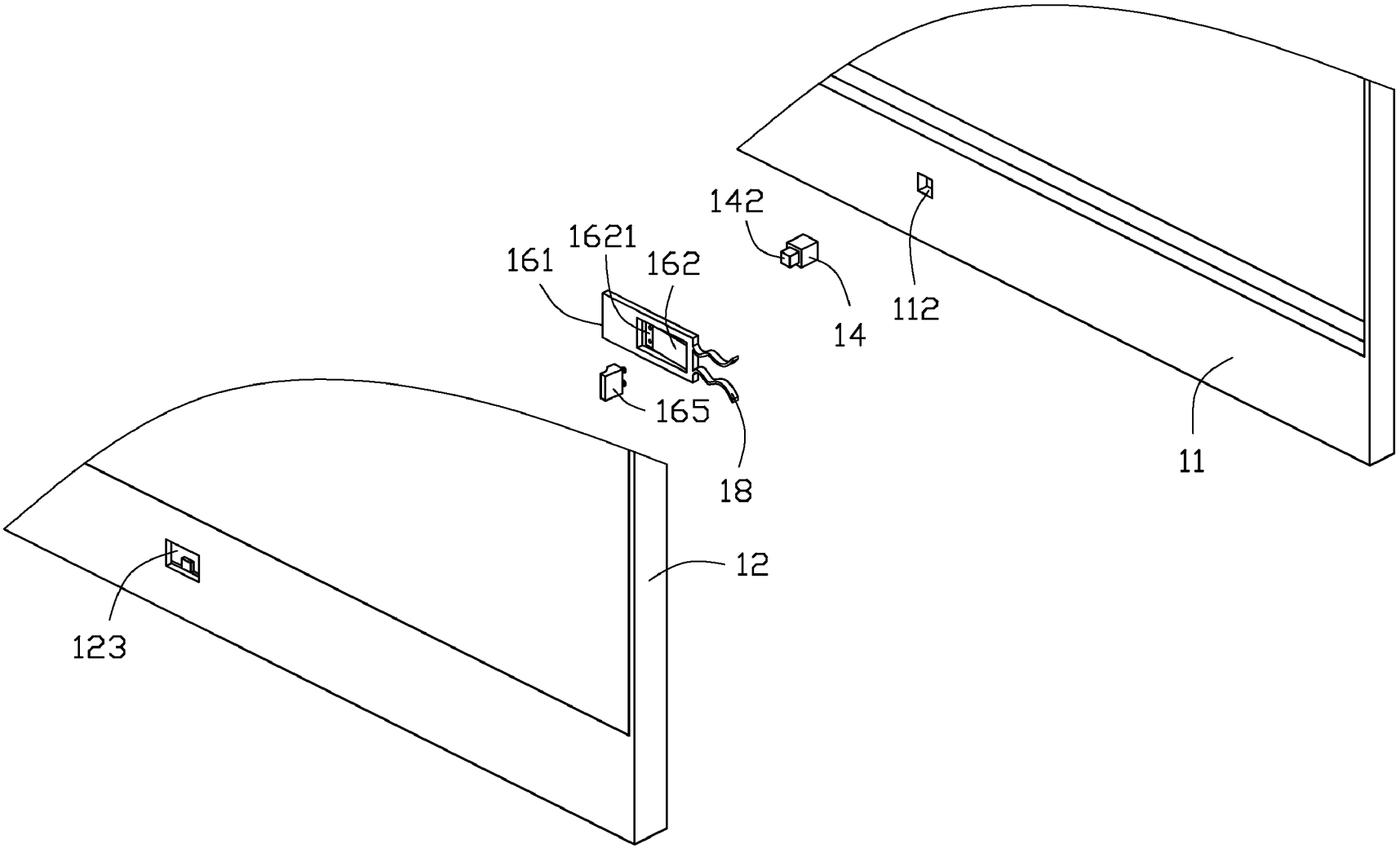
FIG. 2 is a partial, exploded, isometric view of the electronic device in FIG. 1.

Referring to FIGS. 1 and 2, an embodiment of an electronic device 100 includes a first housing part 11, a second housing part 12, a power switch 14, a contact assembly 16 and an elastic reposition member 18. In the illustrated embodiment, the electronic device 100 is a liquid crystal display.

Figure 3:
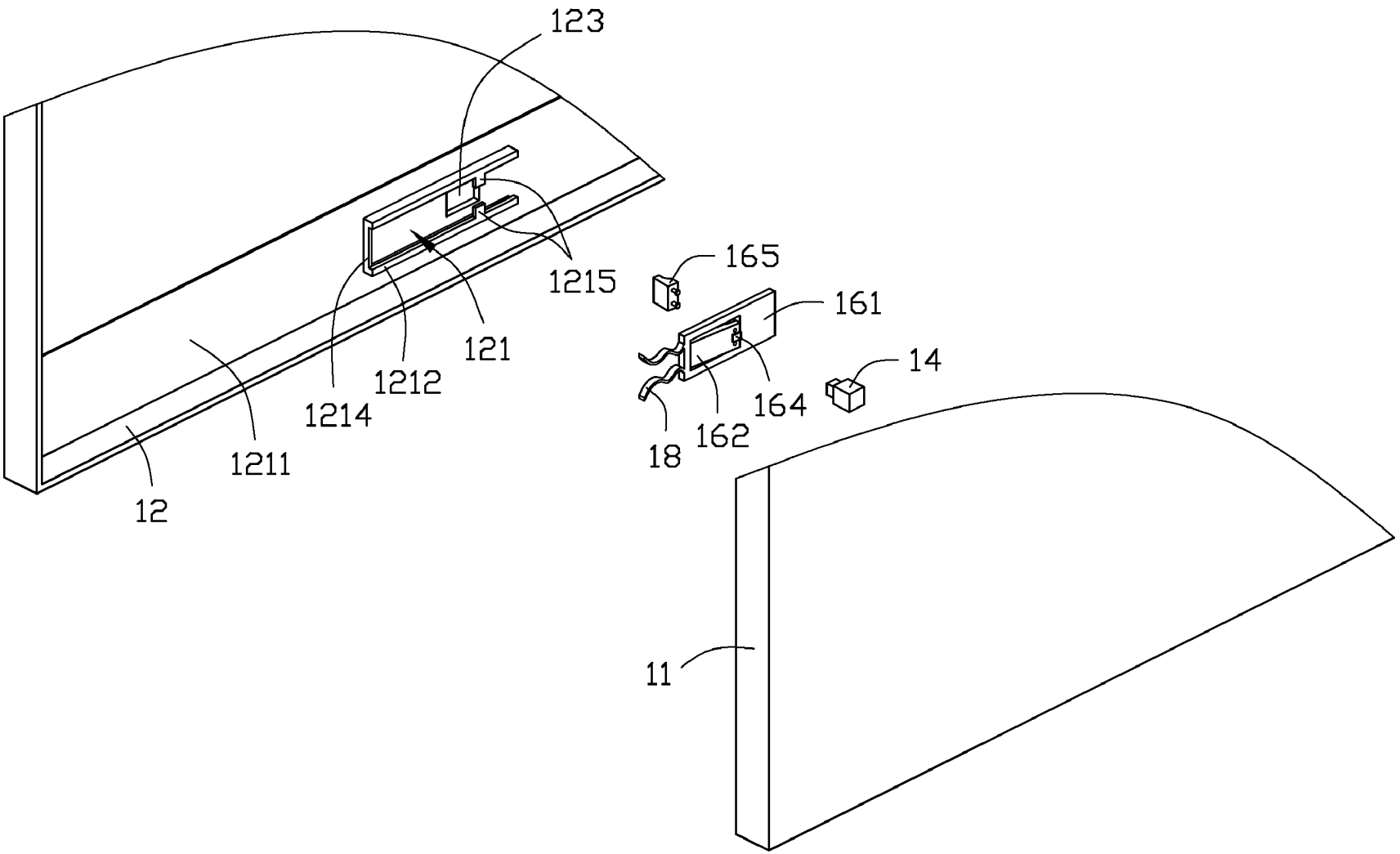
FIG. 3 is similar to FIG. 2, but viewed from another aspect.

Referring also to FIG. 3, the first housing part 11 and the second housing part 12 can be latched with each other, thus cooperatively forming a housing to secure electronic components (not shown) therein. The first and second housing parts 11, 12 are both substantially rectangular frames.

The first housing part 11 defines a securing portion 112 to assemble the power switch 14. The second housing part 12 has an inner surface 1211, and includes two sliding rails 1212 formed on the inner surface 1211, and a connecting rail 1214 connecting the two sliding rails 1212. A part of the inner surface 1211, the sliding rails 1212, and the connecting rail 1214 cooperatively define an elongated sliding groove 121. Each sliding rail 1212 forms a limiting portion 1215 extending from the sliding rail 1212. The two limiting portions 1215 are opposite to each other and away from the connecting rail 1214. The second housing part 12 defines a substantially rectangular assembly hole 123 between the two sliding rails 1212 and adjacent to the limiting portions 1215.

The power switch 14 includes a triggering portion 142 to send a signal to control connection or interruption of power, upon contact with the triggering portion 142.

The contact assembly 16 includes a sliding member 161, an elastic force member 162, a triggering member 164, and a button 165. In the illustrated embodiment, the sliding member 161, the elastic force member 162, and the triggering member 164 are integrally formed together.

The sliding member 161 can be a substantially rectangular plate. The sliding member 161 can be slidably assembled in the sliding groove 121.

The elastic force member 162 can be a substantially rectangular piece formed on the sliding member 161. The elastic force member 162 may be a metal piece formed by punching and bent toward an end of the sliding member 161. The elastic force member 162 includes a free end 1621. The triggering member 164 is positioned on a first side surface of the free end 1621. The button 165 is positioned on a second side surface of the free end 1621 opposite to the triggering member 164.

The elastic reposition member 18 provides elastic force between the sliding member 161 and the connecting rail 1214. The elastic reposition member 18 is positioned in the sliding groove 121, with two ends thereof abutting the sliding member 161 and the connecting rail 1214 respectively. In the illustrated embodiment, the elastic reposition member 18 are two corrugated elastic pieces integrally formed with the sliding member 161. The corrugated elastic pieces can elastically deform by compression or extension.

During assembly, the power switch 14 is fixed in the securing portion 112 of the first housing part 11. The sliding member 161 is slidably positioned in the sliding groove 121. The button 165, positioned on the elastic force member 162, passes through the assembly hole 123 of the second housing part 12. The first and second housing parts 11, 12 are latched together, and the free end 1621 of the elastic force member 162 protrudes slightly from the sliding member 161.

Figure 4:
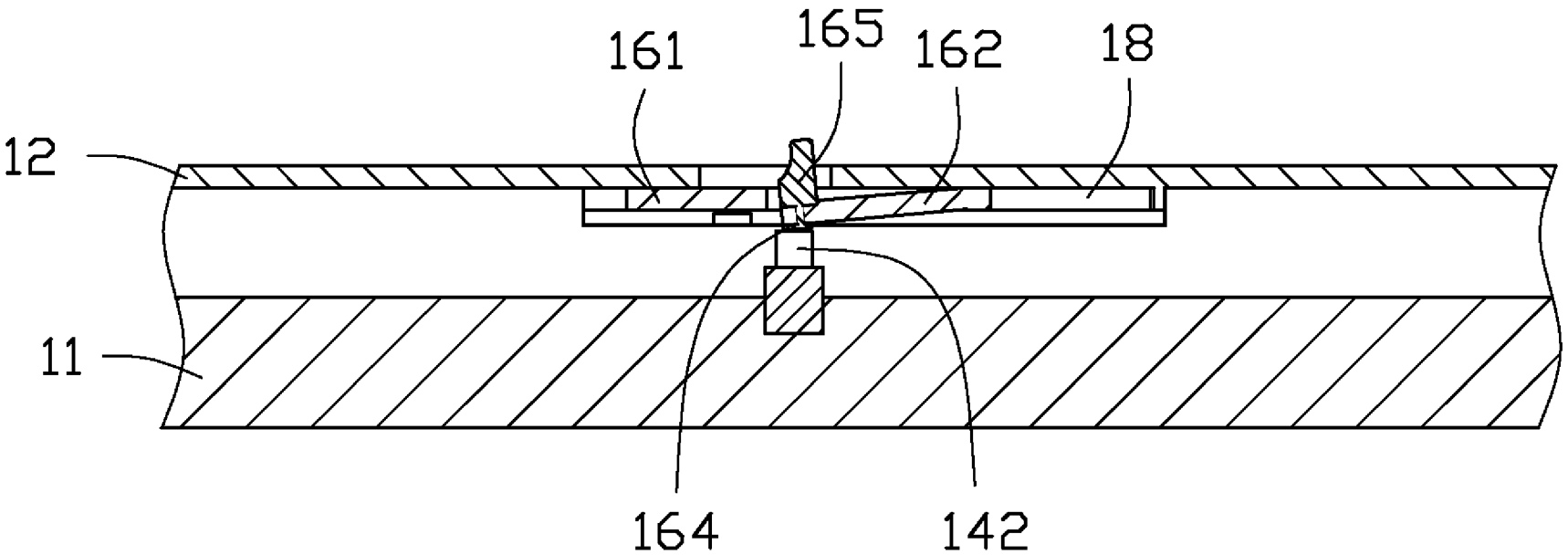
FIG. 4 is a cross-section of the electronic device taken along line IV-IV in FIG. 1, showing the triggering member in a first position.
Figure 5:
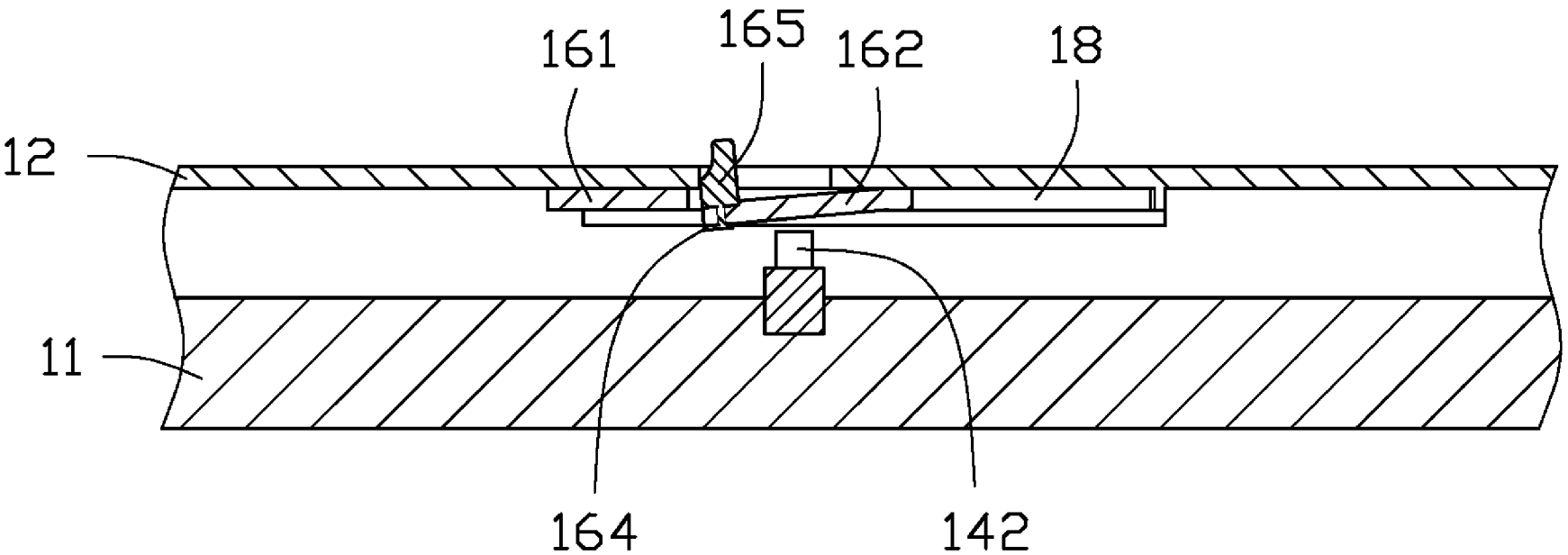
FIG. 5 is similar to FIG. 4, but showing the triggering member in a second position.

FIGS. 4 and 5 show the triggering member 164 moved in a first position and a second position relative to the power switch 14 respectively. When the sliding member 161 slides in the sliding groove 121, the triggering member 164 slides between the first and the second positions relative to the power switch 14.

In a first position, the triggering member 164 faces the power switch 14. An external force moves the button 165 toward the triggering portion 142, whereby the triggering member 164 contacts the triggering portion 142. Thus, the triggering portion 142 sends a signal to control the connection or interruption of the power.

In a second position, the triggering member 164 faces away from the power switch 14. In this position, even in the event of unintended pressure on the button 165 the triggering member 164 cannot contact the triggering portion 142. Thus, the triggering portion 142 cannot be triggered by misoperation during the normal working state, and operational problems associated therewith can be avoided.

The elastic force generated by the elastic reposition member 18 must be overcome before the triggering member 164 can move from the second position to the first position. When an external force slides the button 165 along the sliding groove 121, the triggering member 164 gradually moves towards the triggering portion 142, and the elastic reposition member 18 deforms elastically and accumulates elastic potential energy. The free end 1621 of the elastic force member 162 abuts the limiting portions 1215, thus defining a movable range of the elastic force member 162.

When the triggering member 164 is in the first position, the power switch 14 can be controlled by pressing the button 165. When the force applied on the button 165 is released, the triggering member 164, together with the sliding member 161, is reverted and retained in the second position due to the elastic force generated by the elastic reposition member 18.

In alternative embodiments, the electronic device 100 may be a host computer, a notebook computer, or other electronic device. The power switch 14 and the contact assembly 16 may be assembled on other portions of the electronic device 100, other than the first and second housing part 11, 12. Accordingly, the portion of the electronic device 100 may define a sliding groove to latch with the sliding assembly 16.

It is believed that the present embodiments and their advantages will be understood from the foregoing description, and it will be apparent that various changes may be made thereto without departing from the spirit and scope of the disclosure or sacrificing all of its material advantages.

What is claimed is:

1. An electronic device comprising:
a power switch;
an elastic force member adjacent to the power switch;
a triggering member fixed on the elastic force member to trigger the power switch, the triggering member being capable of sliding between a first position and a second position relative to the power switch;
an elastic reposition member providing elastic force to move the triggering member from the first position to the second position; and
a sliding member fixed on the elastic force member, wherein the elastic reposition member is two corrugated elastic pieces integrally formed with the sliding member;
wherein in the first position, the triggering member faces the power switch and can be pressed to trigger the power switch; in the second position, the triggering member is away from the power switch.

2. The electronic device of claim 1, further comprising a first housing part and a second housing part, the first housing part comprising a securing portion to secure the power switch, and the second housing part defining a sliding groove, in which the sliding member is slidably positioned.

3. The electronic device of claim 2, wherein the sliding groove is cooperatively defined by two sliding rails and a connecting rail formed on an inner surface of the second housing part; the two sliding rails are opposite each other and connected by the connecting rail.

4. The electronic device of claim 3, wherein the elastic reposition member is positioned in the sliding groove, and two ends of the elastic reposition member abut the elastic force member and the connecting rail respectively.

5. The electronic device of claim 3, wherein each sliding rail comprises a limiting portion extending from the sliding rail, and the limiting portion abuts the elastic force member, thus defining a movable range of the elastic force member.

6. The electronic device of claim 2, further comprising a button fixed on the elastic force member opposite to the triggering member, wherein the second housing part defining an assembly hole through which the button passes.

7. The electronic device of claim 1, wherein the elastic force member comprises a free end on which the triggering member is fixed.

8. An electronic device comprising:
a first housing part;
a second housing part latching with the first housing part, the second housing part defining a sliding groove;
a power switch assembled on the first housing part;
an elastic force member slidably positioned in the sliding groove;
a triggering member fixed on the elastic force member to trigger the power switch, the triggering member being capable of sliding between a first position and a second position relative to the power switch;
an elastic reposition member positioned in the sliding groove and providing elastic force to move the triggering member from the first position to the second position; and
a sliding member slidably positioned in the sliding groove, the elastic force member is fixed on the sliding member, wherein the elastic reposition member is two corrugated elastic pieces integrally formed with the sliding member;
wherein the triggering member faces the power switch in the first position such that the power switch can be triggered when the triggering member is pressed; the triggering member is away from the power switch in the second position such that the power switch cannot be triggered when the triggering member is pressed.

9. The electronic device of claim 8, wherein the first housing part comprising a securing portion to secure the power switch.

10. The electronic device of claim 8, wherein the sliding groove is cooperatively defined by two sliding rails and a connecting rail formed on an inner surface of the second housing part; the two sliding rails are opposite each other and connected by the connecting rail.

11. The electronic device of claim 10, further comprising a sliding member slidably positioned in the sliding groove, on which the elastic force member is fixed, wherein two ends of the elastic reposition member abut the elastic force member and the connecting rail respectively.

12. The electronic device of claim 10, wherein each sliding rail comprises a limiting portion extending from the sliding rail and abutting the elastic force member, thus defining a movable range of the elastic force member.

13. The electronic device of claim 8, further comprising a button fixed on the elastic force member opposite to the triggering member; the second housing part defining an assembly hole, the button passing through the assembly hole.

14. The electronic device of claim 8, wherein the elastic force member comprises a free end on which the triggering member is fixed.

15. An electronic device comprising:
a first housing part;
a second housing part latching with the first housing part, the second housing part defining a sliding groove;
a power switch assembled on the first housing part;
an elastic force member slidably positioned in the sliding groove;
a triggering member fixed on the elastic force member to trigger the power switch, the triggering member being capable of sliding between a first position and a second position relative to the power switch;
an elastic reposition member positioned in the sliding groove and providing elastic force to move the triggering member from the first position to the second position; and
a button fixed on the elastic force member opposite to the triggering member; the second housing part defining an assembly hole, the button passing through the assembly hole;
wherein the triggering member faces the power switch in the first position such that the power switch can be triggered when the triggering member is pressed; the triggering member is away from the power switch in the second position such that the power switch cannot be triggered when the triggering member is pressed.

* * * * *